US009463854B2

(12) United States Patent
Kinoshita

(10) Patent No.: US 9,463,854 B2
(45) Date of Patent: Oct. 11, 2016

(54) JET PROPELLED WATERCRAFT

(71) Applicant: Yamaha Hatsudoki Kabushiki Kaisha, Iwata-shi, Shizuoka (JP)

(72) Inventor: Yoshimasa Kinoshita, Shizuoka (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 468 days.

(21) Appl. No.: 13/948,347

(22) Filed: Jul. 23, 2013

(65) Prior Publication Data

US 2014/0102075 A1 Apr. 17, 2014

(30) Foreign Application Priority Data

Oct. 12, 2012 (JP) ..... 2012-227077

(51) Int. Cl.
*B63H 1/02* (2006.01)
*B63H 11/11* (2006.01)
*B63J 99/00* (2009.01)

(52) U.S. Cl.
CPC ..... *B63H 1/02* (2013.01); *B63H 11/11* (2013.01); *B63B 2241/20* (2013.01); *B63J 2099/006* (2013.01)

(58) Field of Classification Search
CPC ..... B63H 11/11; F16H 2061/1232
USPC ..... 440/40, 41
See application file for complete search history.

(56) References Cited

U.S. PATENT DOCUMENTS 5,154,650 A * 10/1992 Nakase ..... B63H 11/11 114/55.57
5,752,864 A * 5/1998 Jones ..... B63H 11/11 440/41
6,527,670 B1 * 3/2003 Gierer ..... F16H 61/12 192/220
6,547,611 B1 * 4/2003 Boroos ..... F02B 61/045 440/41
6,652,333 B1 11/2003 Adomeit
6,676,462 B2 * 1/2004 Yanagihara ..... B63H 11/11 440/4
7,008,278 B2 * 3/2006 Miura ..... B63H 25/10 440/84
7,970,583 B2 * 6/2011 Novis ..... F15B 15/2815 702/183
8,177,592 B2 * 5/2012 Kamio ..... B63B 35/731 114/145 R
8,177,594 B2 * 5/2012 Dagenais ..... B63H 11/11 441/1

OTHER PUBLICATIONS http://www.americanturbine.com/information/understand_jetboat.htm, published Aug. 21, 2007, retrieved Oct. 6, 2015.*

* cited by examiner

*Primary Examiner* — Andrew Polay
(74) *Attorney, Agent, or Firm* — Keating and Bennett, LLP

(57) ABSTRACT

A jet propelled watercraft includes a jet pump that jets water rearward from a jet port, a reverse gate, a reverse gate moving mechanism, and a withdrawal controller. The reverse gate is movable in an up/down direction between a reverse drive position at which an entirety of the jet port is covered and a forward drive position at which the entirety of the jet port is open. In a state of being positioned at the reverse drive position, the reverse gate guides forward the water that has been guided to the jet port. The reverse gate moving mechanism includes an electric motor that generates power to move the reverse gate between the reverse drive position and the forward drive position, and a transmitting mechanism that connects the electric motor and the reverse gate. The withdrawal controller monitors malfunctions of the reverse gate moving mechanism.

18 Claims, 4 Drawing Sheets

JET PROPELLED WATERCRAFT

BACKGROUND OF THE INVENTION

1. Field of the Invention

The present invention relates to a jet propelled watercraft.

2. Description of the Related Art

A personal watercraft described in U.S. Pat. No. 6,547,611 includes a nozzle that jets water rearward, a reverse gate that opens and closes an opening of the nozzle at a fixed distance from the nozzle opening, and an electrically driven reverse mechanism that moves the reverse gate between an upper position and a lower position. The upper position is a position at which the reverse gate is withdrawn upward from the nozzle opening and the lower position is a position at which the reverse gate faces the nozzle opening. A neutral position is a position between the upper position and the lower position.

SUMMARY OF THE INVENTION

The inventor of preferred embodiments of the present invention described and claimed in the present application conducted an extensive study and research regarding jet propelled watercrafts, such as the one described above, and in doing so, discovered and first recognized new unique challenges and previously unrecognized possibilities for improvements as described in greater detail below.

Measures to be taken in case of a malfunction of the electrically driven reverse mechanism are not disclosed in U.S. Pat. No. 6,547,611. When a malfunction of the electrically driven reverse mechanism occurs, unless the reverse gate is withdrawn to the upper position (forward drive position), the water jetted from the nozzle is blocked by the reverse gate and a rider cannot cause the jet propelled watercraft to be driven forward efficiently and move smoothly to a port or other destination.

In order to overcome the previously unrecognized and unsolved challenges described above, a preferred embodiment of the present invention provides a jet propelled watercraft including a jet pump, a reverse gate, a reverse gate moving mechanism, and a withdrawal controller. The jet pump jets water rearward from a jet port. The reverse gate is movable in an up/down direction between a reverse drive position at which an entirety of the jet port is covered as seen in a rear view of the jet propelled watercraft and a forward drive position at which the entirety of the jet port is open as seen in the rear view. In a state of being positioned at the reverse drive position, the reverse gate guides forward the water that has been guided to the jet port. The reverse gate moving mechanism includes an electric motor that generates power to move the reverse gate between the reverse drive position and the forward drive position, and a transmitting mechanism that defines a transmitting pathway connecting the electric motor and the reverse gate and transmits the power by the electric motor to the reverse gate. The withdrawal controller detects a malfunction of the reverse gate moving mechanism. When a malfunction of the reverse gate moving mechanism is detected, the withdrawal controller causes the reverse gate to withdraw to the forward drive position.

With this arrangement, the reverse gate that opens and closes the jet port of the jet pump is driven by the reverse gate moving mechanism that is electrically driven. Even when the reverse gate moving mechanism malfunctions in a state where the reverse gate is disposed at a position other than the forward drive position, the reverse gate is reliably withdrawn to the forward drive position. A rider can thus cause the jet propelled watercraft to be driven forward and return to port reliably even when the reverse gate moving mechanism malfunctions.

In a preferred embodiment of the present invention, the jet propelled watercraft may further include an interrupting mechanism that interrupts the transmitting pathway so that restraint of the reverse gate by the reverse gate moving mechanism is released. In this case, the transmitting mechanism may include a transmitting member that transmits power by the electric motor to the reverse gate. The interrupting mechanism may include a joint mechanism that detachably connects the transmitting member to the reverse gate.

With this arrangement, the transmitting pathway connecting the electric motor and the reverse gate is interrupted by the interrupting mechanism. As a result, the restraint of the reverse gate by the reverse gate moving mechanism is released. The rider can thus cause the reverse gate to withdraw to the forward drive position regardless of which portion of the reverse gate moving mechanism causes the malfunction. The rider can thus cause the jet propelled watercraft to be driven forward and return to port reliably even when the reverse gate moving mechanism malfunctions.

In a preferred embodiment of the present invention, the withdrawal controller may provide a withdrawal command to the electric motor when the reverse gate moving mechanism malfunctions to cause the reverse gate to move by a predetermined distance toward the forward drive position. In this case, the withdrawal controller may provide to the electric motor the withdrawal command to cause the reverse gate to move toward the forward drive position by a distance from the reverse drive position to the forward drive position to cause the reverse gate to move to the forward drive position.

With this arrangement, the withdrawal command is provided to the electric motor when the reverse gate moving mechanism malfunctions to cause the reverse gate to move toward the forward drive position by the distance from the reverse drive position to the forward drive position. Therefore, even if a malfunction occurs in a state where the reverse gate is disposed at any position from the forward drive position to the reverse drive position, the reverse gate is reliably withdrawn to the forward drive position. The rider can thus cause the jet propelled watercraft to be driven forward and return to port reliably even when the reverse gate moving mechanism malfunctions.

In a preferred embodiment of the present invention, the jet propelled watercraft may further include a resilient member that applies to the reverse gate a force that moves the reverse gate toward the forward drive position. In this case, the withdrawal controller may disable a generation of a braking force applied to a rotating shaft of the electric motor when the reverse gate moving mechanism malfunctions. Specifically, the withdrawal controller may include a driving circuit defining a closed circuit with the electric motor and a switch that interrupts the closed circuit when the reverse gate moving mechanism malfunctions.

With this arrangement, when the reverse gate moving mechanism malfunctions, the generation of the braking force applied to the rotating shaft of the electric motor is disabled and the rotating shaft of the electric motor freely rotates. That is, the electric motor is put in a state where a person can turn the rotating shaft manually. The reverse gate is coupled to the rotating shaft of the electric motor via the transmitting mechanism. In a state where the rotating shaft is fixed, the reverse gate is maintained at a fixed position. Therefore, by disabling the generation of the braking force, the restraint of the reverse gate by the reverse gate moving mechanism is released. Therefore, if the reverse gate is not disposed at the forward drive position, the reverse gate receives a restorative force of the resilient member and moves to the forward drive position. The rider can thus cause the jet propelled watercraft to be driven forward and return to port reliably even when the reverse gate moving mechanism malfunctions.

Another preferred embodiment of the present invention provides a jet propelled watercraft including a jet pump, a reverse gate, a reverse gate moving mechanism, and an interrupting mechanism. The jet pump jets water rearward from a jet port. The reverse gate is movable in an up/down direction between a reverse drive position at which an entirety of the jet port is covered as seen in a rear view of the jet propelled watercraft and a forward drive position at which the entirety of the jet port is open as seen in the rear view. In a state of being positioned at the reverse drive position, the reverse gate guides forward the water that has been guided to the jet port. The reverse gate moving mechanism includes an electric motor that generates power to move the reverse gate between the reverse drive position and the forward drive position, and a transmitting mechanism that defines a transmitting pathway connecting the electric motor and the reverse gate and transmits the power by the electric motor to the reverse gate. The interrupting mechanism interrupts the transmitting pathway so that restraint of the reverse gate by the reverse gate moving mechanism is released. With this arrangement, the same effects as the effects described above can be exhibited.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1:
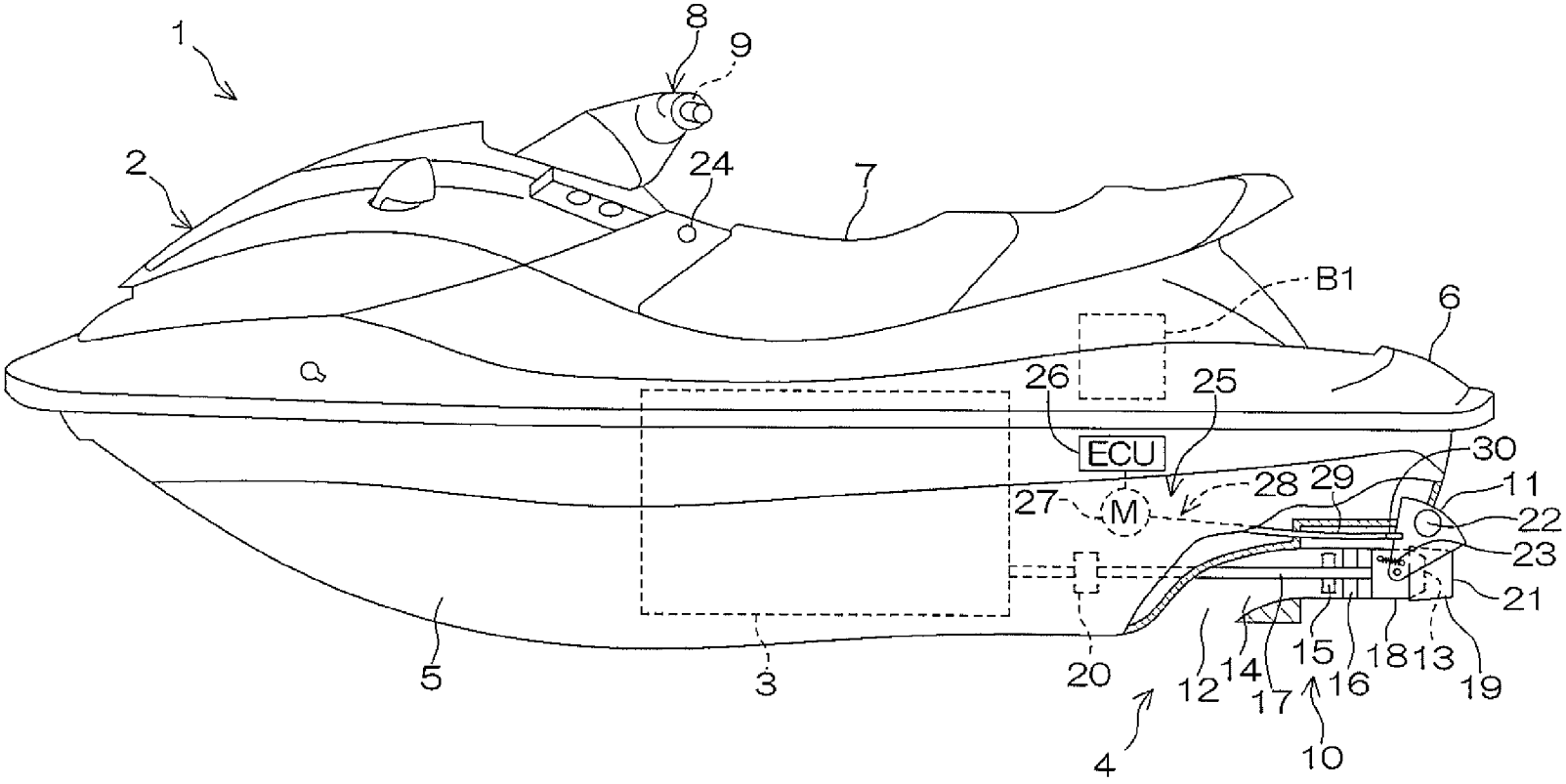
FIG. 1 is a schematic view of a jet propelled watercraft according to a preferred embodiment of the present invention.
Figure 2:
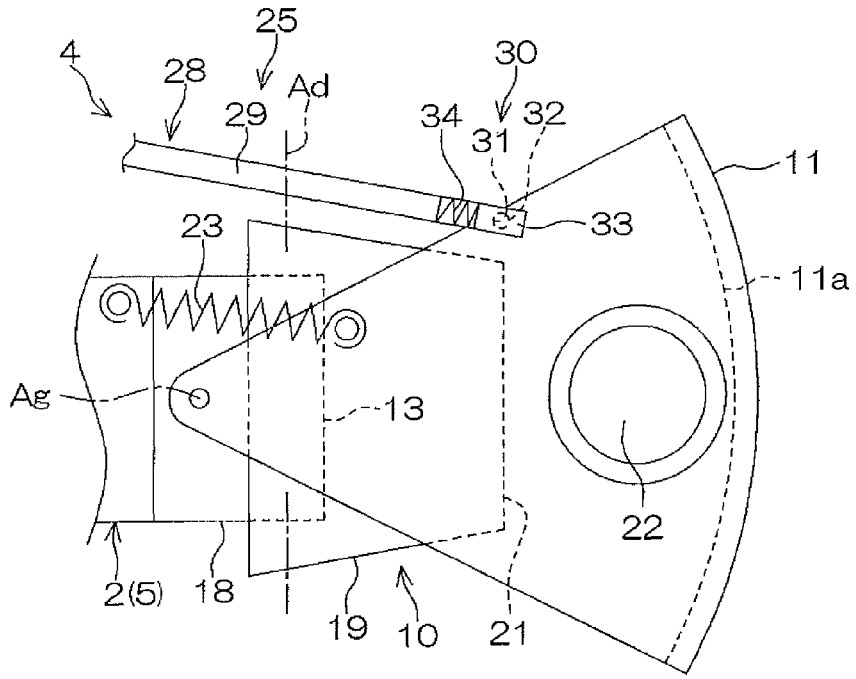
FIG. 2 is a schematic side view of a jet propulsion mechanism.
Figure 3:
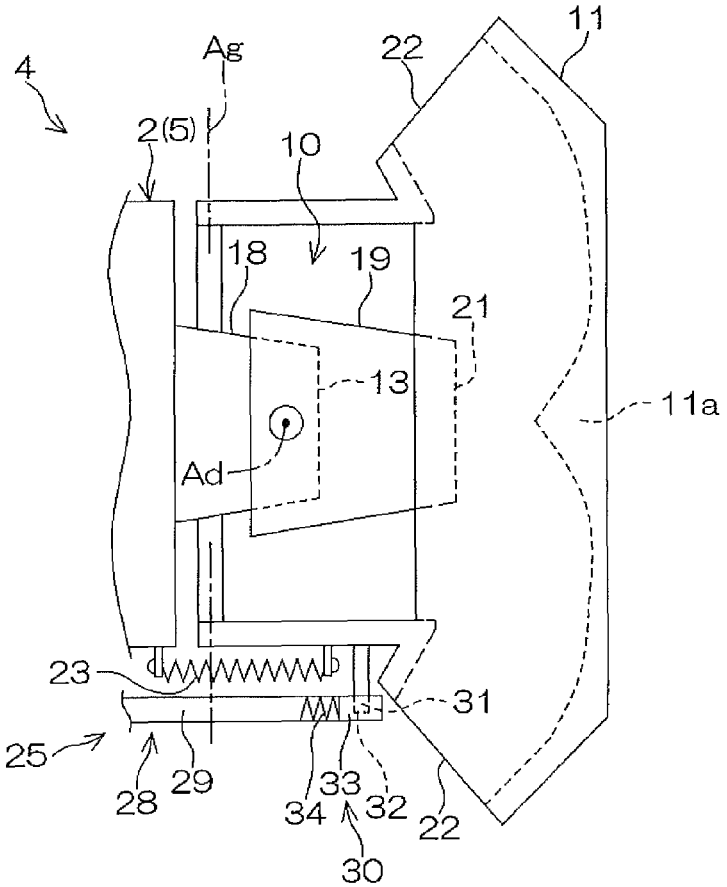
FIG. 3 is a schematic plan view of the jet propulsion mechanism.

FIG. 1 is a schematic view of a jet propelled watercraft 1 according to a preferred embodiment of the present invention. FIG. 2 is a schematic side view of a jet propulsion mechanism 4. FIG. 3 is a schematic plan view of the jet propulsion mechanism 4. An example where the jet propelled watercraft 1 is a personal watercraft (PWC) shall be described below.

As shown in FIG. 1, the jet propelled watercraft 1 includes a body 2, an engine 3 disposed in an interior of the body 2, and the jet propulsion mechanism 4 mounted on a rear portion of the body 2.

As shown in FIG. 1, the body 2 includes a hull 5 defining a watercraft bottom and a deck 6 disposed above the hull 5. The engine 3 is disposed between the hull 5 and the deck 6 in an up/down direction. Similarly, a battery B1 supplying electric power to electrical equipment included in the jet propelled watercraft 1 is disposed between the hull 5 and the deck 6 in the up/down direction. The engine 3 is disposed in front of the jet propulsion mechanism 4. The engine 3 is an internal combustion engine that includes a crankshaft rotatable around a rotation axis extending in a front/rear direction. The jet propulsion mechanism 4 is driven by the engine 3. The jet propulsion mechanism 4 jets water, sucked into the watercraft (into the interior of the body 2) from the watercraft bottom, to an exterior of the watercraft (exterior of the body 2) to propel the jet propelled watercraft 1 forward or in reverse.

As shown in FIG. 1, the jet propelled watercraft 1 includes a seat 7 on which a rider sits, a handle 8 operated to the right and left by the rider, and a throttle 9 mounted on the handle 8.

As shown in FIG. 1, the seat 7 and the handle 8 are disposed above the body 2. The seat 7 and the handle 8 are supported by the body 2. The seat 7 and the handle 8 are disposed at a central portion of the jet propelled watercraft 1 in a width direction (right/left direction). The seat 7 is disposed behind the handle 8. The seat 7 is disposed above the engine 3 and the handle 8 is disposed further to the front than the engine 3. An output of the engine 3 is adjusted by operation of the throttle 9 by the rider. Also, a direction (jetting direction) of a jet flow jetted from the jet propulsion mechanism 4 is changed to the right and left by operation of the handle 8. As a result, the jet propelled watercraft 1 is steered.

As shown in FIG. 1, the jet propulsion mechanism 4 includes a jet pump 10, by which water outside the watercraft is sucked in from the watercraft bottom and jetted rearward from a forward drive jet port 21, and a reverse gate 11 that converts a direction of the jet flow, jetted rearward from the forward drive jet port 21 of the jet pump 10, to a frontward direction.

As shown in FIG. 1, the jet pump 10 includes an intake 12 into which water outside the watercraft is sucked in, an outlet 13 from which the water sucked in from the intake 12 is jetted rearward, and a flow passage 14 that guides the water sucked into the intake 12 to the outlet 13. The jet pump 10 further includes an impeller 15 (rotor vane) and a stator vane 16 that are disposed in the flow passage 14, a driveshaft 17 coupled to the impeller 15, a nozzle 18 defining the outlet 13, and a deflector 19 that deflects the direction of the jet flow, jetted rearward from the nozzle 18, to the right and left.

As shown in FIG. 1, the intake 12 is opened at the watercraft bottom and the outlet 13 is opened rearward further to the rear than the intake 12. The driveshaft 17 extends in the front/rear direction. A front endportion of the driveshaft 17 is disposed inside the watercraft and a rear end portion of the driveshaft 17 is disposed in the flow passage 14. The front end portion of the driveshaft 17 is coupled to the engine 3 via a coupling 20. The impeller 15 is coupled to the driveshaft 17. The stator vane 16 is disposed behind the impeller 15 and the nozzle 18 is disposed behind the stator vane 16. The impeller 15 is rotatable around a central axis of the driveshaft 17 with respect to the flow passage 14 and the stator vane 16 is fixed with respect to the flow passage 14. The nozzle 18 is fixed to the body 2 and does not move with respect to the body 2.

As shown in FIG. 1, the engine 3 drives the impeller 15, together with the driveshaft 17, around the central axis of the driveshaft 17. When the impeller 15 is driven to rotate, water is sucked into the flow passage 14 from the intake 12 and the water sucked into the flow passage 14 is fed from the impeller 15 to the stator vane 16. By the water fed by the impeller 15 passing through the stator vane 16, torsion of water flow formed by rotation of the impeller 15 is reduced and the water flow is straightened. The flow-straightened water is fed from the stator vane 16 to the nozzle 18. The nozzle 18 preferably has a tubular shape extending in the front/rear direction and the outlet 13 is defined by a rear end portion of the nozzle 18. The water fed to the nozzle 18 is thus jetted rearward from the rear end portion of the nozzle 18.

As shown in FIG. 2 and FIG. 3, the deflector 19 extends rearward from the nozzle 18. The deflector 19 is coupled to the nozzle 18 in a manner enabling rotation to the right and left around a deflector axis Ad extending in the up/down direction. The deflector 19 is hollow. The outlet 13 of the nozzle 18 is disposed inside the deflector 19. The deflector 19 includes the forward drive jet port 21 that is opened rearward. The forward drive jet port 21 is disposed behind the outlet 13. Water jetted rearward from the nozzle 18 passes through an interior of the deflector 19 and is jetted rearward from the forward drive jet port 21. The deflector 19 is rotatable to the right and left with respect to the nozzle 18 around a straight travel position (position shown in FIG. 3) as a center.

As shown in FIG. 2 and FIG. 3, the reverse gate 11 includes a rear wall 11*a* as an opening/closing portion that opens and closes the forward drive jet port 21 of the deflector 19 and a pair of right and left reverse drive jet ports 22 that open outward toward the right and left of the rear wall 11*a*. The reverse gate 11 is coupled to the nozzle 18 to enable rotation around a gate axis Ag extending in the right/left direction. The reverse gate 11 is movable between a reverse drive position (position shown in FIG. 2 and FIG. 3) and a forward drive position (position shown in FIG. 1). The forward drive position is a position at which the forward drive jet port 21 is not covered by the reverse gate 11 as seen in a rear view of the jet propelled watercraft 1. The reverse drive position is a position at which an entirety of the forward drive jet port 21 is covered by the reverse gate 11 as seen in the rear view. A neutral position between the forward drive position and the reverse drive position is a position at which only a portion of the forward drive jet port 21 is covered by the reverse gate 11 as seen in the rear view.

In a state where the reverse gate 11 is disposed at the forward drive position, the forward drive jet port 21 of the deflector 19 is not covered and the water jetted rearward from the outlet 13 of the nozzle 18 thus passes through the interior of the deflector 19 and is jetted rearward from the forward drive jet port 21. As a result, a thrust in a forward drive direction is generated. On the other hand, in a state where the reverse gate 11 is disposed at the reverse drive position, the entire forward drive jet port 21 is covered by the reverse gate 11 and the water jetted rearward from the forward drive jet port 21 thus collides against an inner surface of the reverse gate 11 and is jetted obliquely forward to the right or obliquely forward to the left from each reverse drive jet port 22. The reverse gate 11 thus guides the water, jetted rearward from the forward drive jet port 21, toward the front in the state of being positioned at the reverse drive position. As a result, a thrust in a reverse drive direction is generated.

As described above, the deflector 19 is coupled to the nozzle 18 to enable rotation to the right and left around the deflector axis Ad extending in the up/down direction, and the reverse gate 11 is coupled to the nozzle 18 to enable rotation around the gate axis Ag extending in the right/left direction. The reverse gate 11 and the deflector 19 are movable independently of each other. Therefore, when in the state where the reverse gate 11 is disposed at the reverse drive position, the deflector 19 rotates to the right or left around the deflector axis Ad, the reverse gate 11 and the deflector 19 move relatively and a difference between a flow rate of water jetted from the reverse drive jet port 22 at the right and a flow rate of water jetted from the reverse drive jet port 22 at the left changes (see FIG. 3). A direction of thrust is inclined in the right or left direction.

As shown in FIG. 2 and FIG. 3, the jet propulsion mechanism 4 includes a resilient member 23 that applies to the reverse gate 11 a force that moves the reverse gate 11 toward the forward drive position. FIG. 1 to FIG. 3 show an example where the resilient member 23 is a coil spring. One end portion of the resilient member 23 is mounted on the body 2 and another end portion of the resilient member 23 is mounted on the reverse gate 11. The resilient member 23 may be mounted directly on the body 2 or may be mounted indirectly on the body 2 via an interposed member. Similarly, the resilient member 23 may be mounted directly on the reverse gate 11 or may be mounted indirectly on the reverse gate 11 via an interposed member.

As shall be described below, the reverse gate 11 is driven around the gate axis Ag by a reverse gate moving mechanism 25. When the reverse gate 11 moves toward the reverse drive position, an elastic deformation amount of the resilient member 23 (amount of extension of the spring) increases, and when the reverse gate 11 moves toward the forward drive position, the elastic deformation amount of the resilient member 23 decreases. The resilient member 23 thus elongates and contracts in proportion to a movement amount of the reverse gate 11 around the gate axis Ag. A restorative force of the resilient member 23 increases in proportion to a movement amount of the reverse gate 11 from the forward drive position. Therefore, in the state where the reverse gate 11 is disposed at the reverse drive position, the reverse gate 11 is pulled toward the forward drive position by the resilient member 23.

Also, the jet propelled watercraft 1 includes a deflector moving mechanism (not shown) that rotates the deflector 19 to the right or left at a movement amount that is in accordance with a movement amount of the handle 8.

The deflector moving mechanism mechanically couples the handle 8 and the deflector 19. The deflector moving mechanism includes, for example, a push-pull cable that transmits an operation of the handle 8 to the deflector 19. The deflector moving mechanism may be an electrically driven moving mechanism that includes a motor. A straight drive position of the handle 8 corresponds to a straight drive position of the deflector 19. The deflector moving mechanism links the handle 8 and the deflector 19 and causes the deflector 19 to rotate to the right or left by a movement amount that corresponds to the movement amount of the handle 8. The direction of jetting of water from the forward drive jet port 21 is inclined to the right or left.

As shown in FIG. 1, the jet propelled watercraft 1 includes a shift member 24 operated by the rider to move the reverse gate 11 up and down, the reverse gate moving mechanism 25 that moves the reverse gate 11 up and down in accordance with the operation of the shift member 24, and an ECU 26 (electronic control unit) as a withdrawal controller that is programmed to control the electrical equipment included in the jet propelled watercraft 1.

As shown in FIG. 1, the shift member 24 is disposed near the handle 8. The shift member 24 may be a lever, or may be a grip, or may be a switch. The shift member 24 is electrically coupled to the reverse gate moving mechanism 25 via the ECU 26. The reverse gate moving mechanism 25 is thus an electrically driven moving mechanism. The shift member 24 and the reverse gate moving mechanism 25 are electrically connected to the ECU 26. The ECU 26 controls the reverse gate moving mechanism 25 in accordance with the operation of the shift member 24 by the rider. Thus, the reverse gate 11 is rotated around the gate axis Ag.

As shown in FIG. 1, the reverse gate moving mechanism 25 includes an electric motor 27 that generates power to move the reverse gate 11 between the reverse drive position and the forward drive position, and a transmitting mechanism 28 that transmits the power from the electric motor 27. The electric motor 27 is disposed in the interior of the body 2. The electric motor 27 is controlled by the ECU 26. The transmitting mechanism 28 includes a rod-shaped transmitting member 29 that is mounted on the reverse gate 11 outside the watercraft. The transmitting mechanism 28 defines a transmitting pathway connecting the electric motor 27 disposed inside the watercraft and the reverse gate 11 disposed outside the watercraft. The power of the electric motor 27 is thus transmitted to the reverse gate 11 by the transmitting mechanism 28. Thus, the reverse gate 11 is driven around the gate axis Ag.

As shown in FIG. 2 and FIG. 3, the jet propulsion mechanism 4 includes a joint mechanism 30 that detachably connects the transmitting member 29 to the reverse gate 11. The joint mechanism 30 includes a projecting portion 31 and a recessed portion 32 in which the projecting portion 31 is housed. The joint mechanism 30 further includes a stopper 33 movable between a holding position at which the projected portion 31 is held inside the recessed portion 32 (position shown in FIG. 2 and FIG. 3) and a released position at which an opening portion of the recessed portion 32 is opened and a spring 34 urging the stopper 33 toward the holding position. The projecting portion 31 is provided on the reverse gate 11 and the recessed portion 32 is provided on the transmitting member 29. The stopper 33 and the spring are mounted on the transmitting member 29. The joint mechanism 30 is not restricted to such a structure and may be a mechanism that includes a threaded shaft and a threaded hole or may be a mechanism that includes a hook.

A spring constant of the spring 34 of the joint mechanism 30 is set to a magnitude that enables the rider to move the stopper 33. Therefore, when the rider pushes the stopper 33 to the released position, that is, when the transmitting member 29 is slid in an axial direction, the spring 34 deforms elastically and the stopper 33 moves to the released position. As a result, the opening portion of the recessed portion 32 is opened. When the rider then releases the stopper 33, the stopper 33 is returned to the holding position by the restorative force of the spring 34. The rider can thus insert the projecting portion 31 into the recessed portion 32 or remove the projecting portion 31 from the recessed portion 32 by moving the stopper 33 to the released position.

When the projecting portion 31 of the joint mechanism 30 is removed from the recessed portion 32 of the joint mechanism 30, the coupling of the transmitting member 29 and the reverse gate 11 is disengaged. The reverse gate 11 is maintained at a fixed position by the coupling of the transmitting member 29 and the reverse gate 11. When the coupling of the transmitting member 29 and the reverse gate 11 is disengaged, the transmitting pathway connecting the electric motor 27 and the reverse gate 11 is interrupted and the restraint of the reverse gate 11 by the reverse gate moving mechanism 25 is released. As described above, in the state where the reverse gate 11 is moving toward the front drive position, the reverse gate 11 is being pulled toward the forward drive position by the resilient member 23. Therefore, when the transmitting pathway is interrupted in this state, the reverse gate 11 moves toward the forward drive position and is disposed at the forward drive position.

Figure 4:
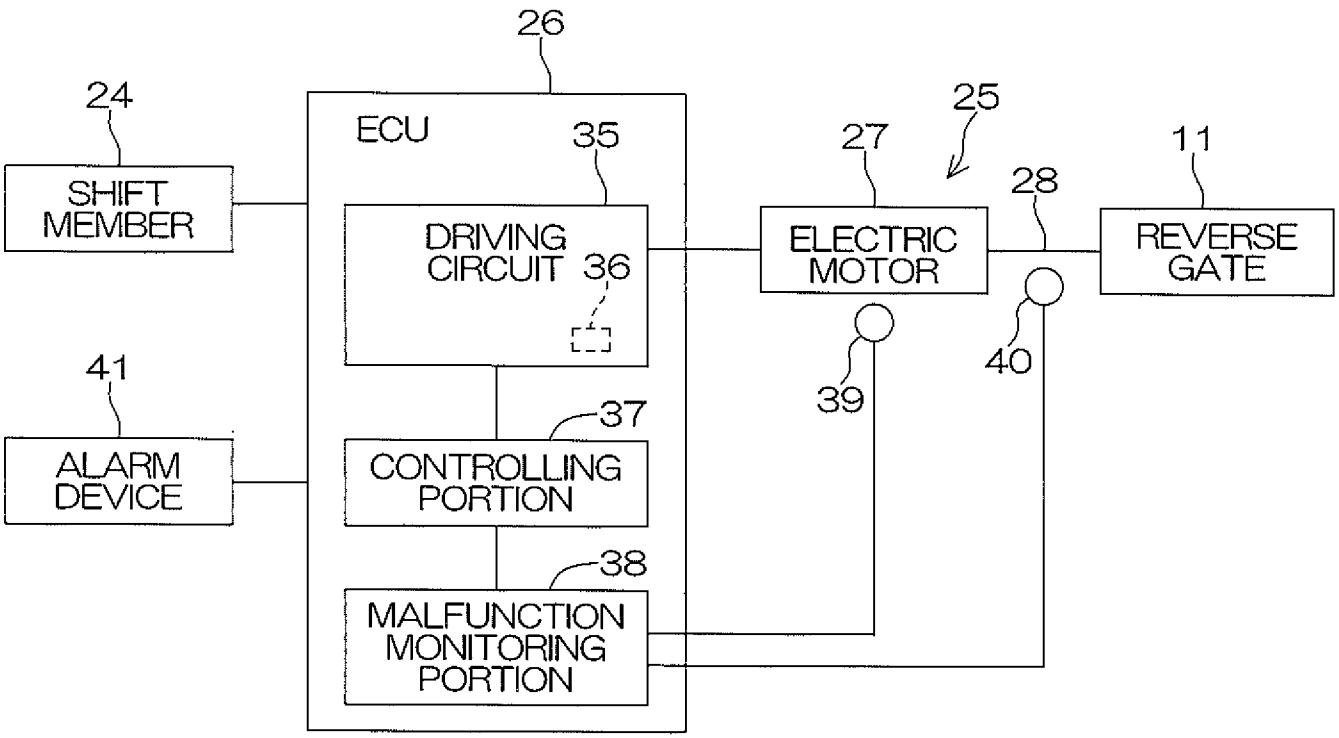
FIG. 4 is a block diagram of an electrical arrangement of the jet propelled watercraft.

FIG. 4 is a block diagram of an electrical arrangement of the jet propelled watercraft 1.

The ECU 26 includes a driving circuit 35 connected to terminals of the electric motor 27, a switch 36 that opens and closes the driving circuit 35, a controlling portion 37 programmed to control a supply of electric power from the driving circuit 35 to the electric motor 27, and a malfunction monitoring portion 38 programmed to monitor the reverse gate moving mechanism 25, including the electric motor 27, for malfunctions.

The driving circuit 35 defines at least a portion of a closed circuit together with the electric motor 27. The switch 36 is disposed in the driving circuit 35. The switch 36 may be a transistor or may be a relay. The switch 36 is controlled by the controlling portion 37. The driving circuit 35 is interrupted by the switch 36. The closed circuit, at least a portion of which is defined by the driving circuit 35 and the electric motor 27, is thus interrupted by the switch 36.

In the state where the closed circuit is interrupted, an electrical braking force applied to the rotating shaft of the electric motor 27 is not generated and the rotating shaft of the electric motor 27 freely rotates. That is, the electric motor 27 is put in a state where the rotating shaft can be turned manually by a person. The reverse gate 11 is coupled to the rotating shaft of the electric motor 27 via the transmitting mechanism 28. In the state where the rotating shaft is fixed, the reverse gate 11 is maintained at a fixed position. Therefore, by the interruption of the closed circuit, the restraint of the reverse gate 11 by the reverse gate moving mechanism 25 is released. Therefore, if the reverse gate 11 is not disposed at the forward drive position, the reverse gate 11 receives the restorative force of the resilient member 23 and moves to the forward drive position.

The reverse gate moving mechanism 25 includes a motor position detector 39 that detects a rotation position of the electric motor 27, and a reverse gate position detector 40 that detects a position of the reverse gate 11.

The motor position detector 39 and the reverse gate position detector 40 are disposed inside the watercraft. The motor position detector 39 is mounted on the electric motor 27. The reverse gate position detector 40 is mounted on a member within the transmitting pathway. The motor position detector 39 may be any of a potentiometer, a rotary encoder, a resolver, or a Hall IC (Hall integrated circuit) or may include two or more of the above. A device besides these may be used as the motor position detector 39. The same applies to the reverse gate position detector 40.

The jet propelled watercraft 1 includes an alarm device 41 that notifies a malfunction of the reverse gate moving mechanism 25 to the rider.

The alarm device 41 is connected to the ECU 26. The alarm device 41 is controlled by the ECU 26. The alarm device 41 may be a buzzer or a lamp or may be a display device that displays warning information. The alarm device 41 may include two or more of the above. A device besides these may be used as the alarm device 41. The malfunction monitoring portion 38 of the ECU 26 constantly monitors the reverse gate moving mechanism 25 for malfunctions. When the malfunction monitoring portion 38 detects a malfunction of the reverse gate moving mechanism 25, the ECU 26 notifies the rider of the malfunction of the reverse gate moving mechanism 25 by the alarm device 41.

The malfunction monitoring portion 38 of the ECU 26 monitors the reverse gate moving mechanism 25 for malfunctions based on detection values of the motor position detector 39 and the reverse gate position detector 40. Specifically, the malfunction monitoring portion 38 monitors whether or not the detection value of the motor position detector 39 and the detection value of the reverse gate position detector 40 satisfy a predetermined correlation. Further, the malfunction monitoring portion 38 monitors whether or not the respective detection values of the motor position detector 39 and the reverse gate position detector 40 are normal, that is, whether or not the respective detection values match command values from the ECU 26.

For example, when one of either the motor position detector 39 or the reverse gate position detector 40 is malfunctioning or when the transmitting mechanism 28 is malfunctioning, the two detection values of the motor position detector 39 and the reverse gate position detector 40 deviate from the predetermined correlation. Such a malfunction is thus detected by the malfunction monitoring portion 38 monitoring whether or not the two detection values satisfy the predetermined correlation.

When both the motor position detector 39 and the reverse gate position detector 40 are malfunctioning or when an electric wire connecting the motor position detector 39 or the reverse gate position detector 40 to the ECU 26 is interrupted, the two detection values may satisfy the predetermined correlation. Such a malfunction is thus detected by the malfunction monitoring portion 38 monitoring whether or not the command values from the ECU 26 and the respective detection values are matched.

Figure 5:
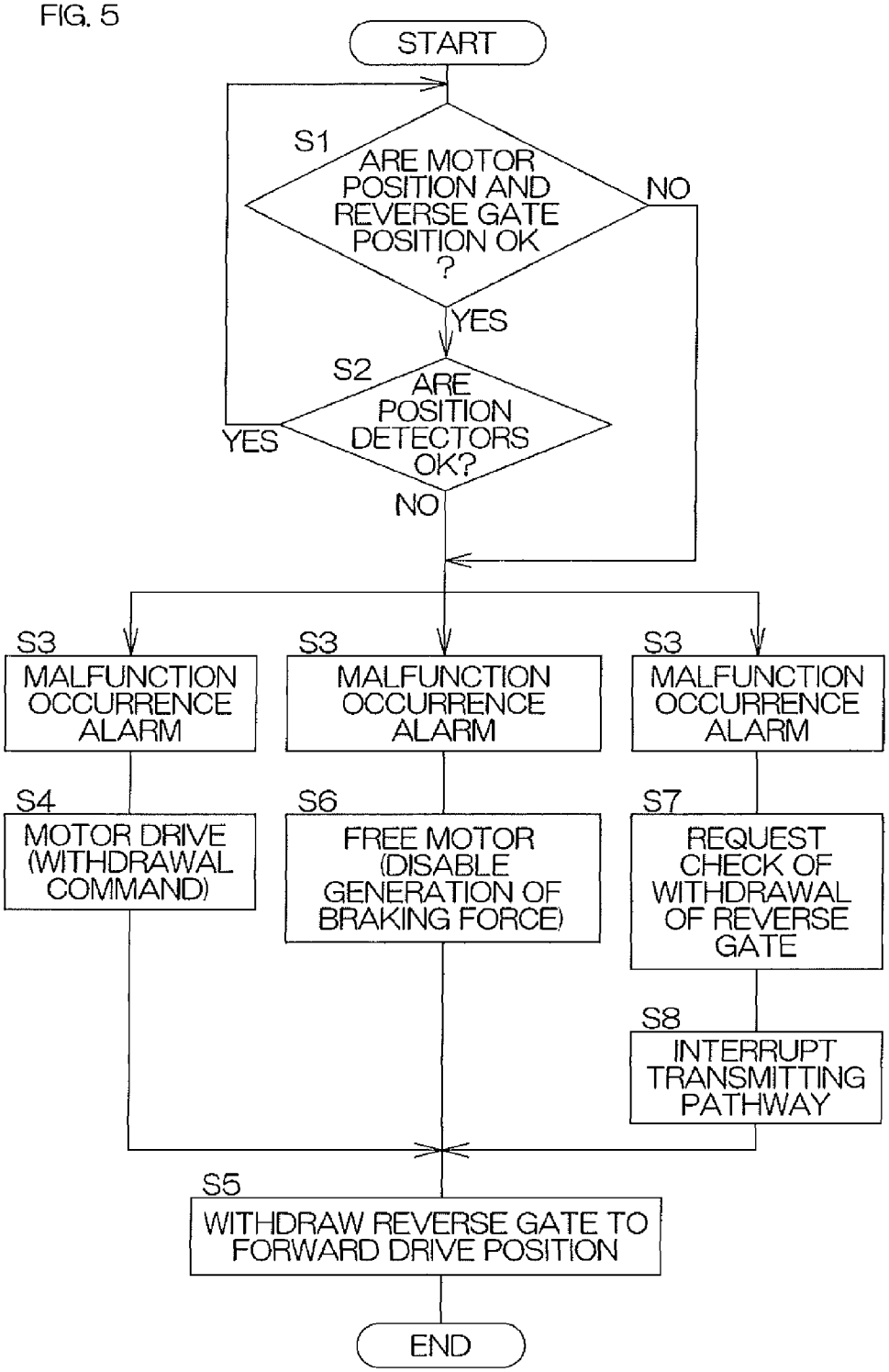
FIG. 5 is a flowchart for monitoring a reverse gate moving mechanism for malfunctions.

FIG. 5 is a flowchart showing a process for monitoring the reverse gate moving mechanism 25 for malfunctions.

When the reverse gate moving mechanism 25 is being monitored for malfunctions, the malfunction monitoring portion 38 of the ECU 26 judges whether or not the two detection values of the motor position detector 39 and the reverse gate position detector 40 satisfy the predetermined correlation (step S1). If the two detection values satisfy the predetermined correlation (in the case of Yes in step S1), the malfunction monitoring portion 38 of the ECU 26 judges whether or not the respective detection values of the motor position detector 39 and the reverse gate position detector 40 are normal (step S2). If the respective detection values are normal (in the case of Yes in step S2), whether or not the two detection values satisfy the predetermined correlation is judged again (return to step S1).

On the other hand, if the two detection values do not satisfy the predetermined correlation (in the case of No in step S1) or the respective detection values are not normal (in the case of No in step S2), the ECU 26 executes one of a first withdrawal control, a second withdrawal control, and a third withdrawal control described below.

In the first withdrawal control, the ECU 26 notifies the rider of the malfunction of the reverse gate moving mechanism 25 by the alarm device 41 (step S3 at the left end). Further, the ECU 26 provides, to the electric motor 27, a withdrawal command to cause the reverse gate 11 to move toward the forward drive position by a distance from the reverse drive position to the forward drive position (step S4). Therefore, in a case where a cause of the malfunction lies in the motor position detector 39 or the reverse gate position detector 40 or the interruption of the electrical wire connecting the motor position detector 39 or the reverse gate position detector 40 to the ECU 26, the reverse gate 11 is reliably disposed at the forward drive position and withdrawn to the forward drive position (step S5).

In the second withdrawal control, the ECU 26 notifies the rider of the malfunction of the reverse gate moving mechanism 25 by the alarm device 41 (step S3 at the center). Further, the ECU 26 interrupts the closed circuit at least a portion of which is defined by the driving circuit 35 and the electric motor 27 (step S6). The restraint of the reverse gate 11 by the reverse gate moving mechanism 25 is thus released. Therefore, if the reverse gate 11 is disposed at a position other than the forward drive position, the reverse gate 11 receives the restorative force of the resilient member 23 and moves to the forward drive position. Therefore, even if the cause of the malfunction is the transmitting mechanism 28 of the reverse gate moving mechanism 25, the reverse gate 11 is withdrawn to the forward drive position and maintained at the forward drive position (step S5).

Also, in the third withdrawal control, the ECU 26 notifies the rider of the malfunction of the reverse gate moving mechanism 25 by the alarm device 41 (step S3 at the right end). Further, the ECU 26 uses the alarm device 41 to urge the rider to check the withdrawal of the reverse gate 11 to the forward drive position (step S7). If the reverse gate 11 is not withdrawn to the forward drive position, the transmitting member 29 of the transmitting mechanism 28 is removed from the reverse gate 11 by the rider and the transmitting pathway is interrupted (step S8). Therefore, regardless of which portion of the reverse gate moving mechanism 25 causes the malfunction, the reverse gate 11 is withdrawn to the forward drive position and maintained at the forward drive position by receiving the restorative force of the resilient member 23 (step S5).

As described above, with the preferred embodiments of the present invention, the reverse gate 11 that opens and closes the forward drive jet port 21 of the jet pump 10 is driven by the electrically driven reverse gate moving mechanism 25. Even when the reverse gate moving mechanism 25 malfunctions in the state where the reverse gate 11 is disposed at a position other than the forward drive position, the reverse gate 11 can be withdrawn to the forward drive position reliably. That is, a plurality of measures are provided to withdraw the reverse gate 11 to the forward drive position and therefore regardless of which portion of the reverse gate moving mechanism 25 causes the malfunction of the reverse gate moving mechanism 25, the reverse gate 11 is withdrawn to the forward drive position reliably. The rider can thus cause the jet propelled watercraft 1 to be driven forward and return to port reliably even when the reverse gate moving mechanism 25 malfunctions.

Although preferred embodiments of the present invention have been described above, the present invention is not restricted to the contents of the preferred embodiments and various modifications are possible within the scope defined by the claims.

For example, with a preferred embodiment of the present invention, the jet propelled watercraft 1 is a personal watercraft (PWC). However, the jet propelled watercraft 1 may be a boat instead.

Also with a preferred embodiment of the present invention, a number of the jet propulsion mechanism 4 included in the jet propelled watercraft 1 is one. However, the jet propelled watercraft 1 may include a plurality of jet propulsion mechanisms 4 instead.

Also with a preferred embodiment of the present invention, the transmitting member 29 is connected to the reverse gate 11 by the joint mechanism 30 outside the watercraft, and the transmitting pathway connecting the electric motor 27 and the reverse gate 11 is interrupted outside the watercraft when the reverse gate moving mechanism 25 malfunctions. However, the transmitting pathway may be interrupted inside the watercraft instead.

Also with a preferred embodiment of the present invention, one of the three withdrawal controls of withdrawing the reverse gate 11 to the forward drive position is performed when the reverse gate moving mechanism 25 malfunctions. However, two or more of the three withdrawal controls may be performed instead.

Also with a preferred embodiment of the present invention, the reverse gate 11 includes two reverse drive jet ports 22 that open obliquely forward to the right and obliquely forward to the left. However, a number of the reverse drive jet ports 22 provided in the reverse gate 11 may be one or may be three or more.

An arrangement is also possible where the forward drive jet port 21 of the deflector 19 is closed by the reverse gate 11 positioned at the reverse drive position. That is, the reverse gate 11 at the reverse drive position may be arranged to be close to the forward drive jet port 21 so that hardly any water is jetted from the forward drive jet port 21. In this case, the reverse drive jet ports 22 may be omitted from the reverse gate 11 and the deflector 19 may be provided with a reverse drive jet port opening obliquely downward at a position further to the front than the forward drive jet port 21. The water flow is thus reversed by the reverse gate 11 and jetted obliquely forward and downward from the reverse drive jet port provided in the deflector 19.

The present application corresponds to Japanese Patent Application No. 2012-227077 filed in the Japan Patent Office on Oct. 12, 2012, and the entire disclosure of the application is incorporated herein by reference.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A jet propelled watercraft comprising:

a jet pump that jets water rearward from a jet port;

a reverse gate movable in an up/down direction between a reverse drive position at which an entirety of the jet port is covered by the reverse gate as seen in a rear view and a forward drive position at which the entirety of the jet port is open as seen in the rear view, the reverse gate being arranged to guide forward the water that has been guided to the jet port when the reverse gate is at the reverse drive position;

a reverse gate mover including an electric motor that generates power to move the reverse gate between the reverse drive position and the forward drive position, and a transmission that defines a transmitting pathway connecting the electric motor and the reverse gate and transmits the power by the electric motor to the reverse gate; and a withdrawal controller programmed to monitor for a malfunction in the reverse gate mover, the withdrawal controller further programmed to cause the reverse gate to withdraw to the forward drive position when the reverse gate mover malfunctions; wherein the withdrawal controller is programmed to monitor for the malfunction of the reverse gate mover based on detection values of a motor position detector and detection values of a reverse gate position detector.

2. The jet propelled watercraft according to claim 1, further comprising a detachable joint arranged to interrupt the transmitting pathway so that restraint of the reverse gate by the reverse gate mover is released.

3. The jet propelled watercraft according to claim 1, further comprising an interrupter arranged to interrupt the transmitting pathway so that restraint of the reverse gate by the reverse gate mover is released; wherein the transmission includes a transmitting member that transmits the power by the electric motor to the reverse gate, and the interrupter includes a joint that detachably connects the transmitting member to the reverse gate.

4. The jet propelled watercraft according to claim 1, wherein the withdrawal controller is programmed to provide a withdrawal command to the electric motor when the reverse gate mover malfunctions to cause the reverse gate to move by a predetermined distance toward the forward drive position.

5. The jet propelled watercraft according to claim 4, wherein the withdrawal controller is programmed to provide to the electric motor the withdrawal command to cause the reverse gate to move toward the forward drive position by the predetermined distance from the reverse drive position to the forward drive position to cause the reverse gate to move to the forward drive position.

6. The jet propelled watercraft according to claim 1, further comprising a resilient member that applies to the reverse gate a force that moves the reverse gate toward the forward drive position, wherein the withdrawal controller is programmed to disable a generation of a braking force applied to a rotating shaft of the electric motor when the reverse gate mover malfunctions.

7. The jet propelled watercraft according to claim 6, wherein the withdrawal controller includes a driving circuit that defines a closed circuit with the electric motor and a switch that interrupts the closed circuit when the reverse gate mover malfunctions.

8. A jet propelled watercraft comprising:

a jet pump that jets water rearward from a jet port;

a reverse gate movable in an up/down direction between a reverse drive position at which an entirety of the jet port is covered by the reverse gate when the jet port is viewed from the rear and a forward drive position at which the entirety of the jet port is open in the rear view, the reverse gate being arranged to guide forward the water that has been guided to the jet port when the reverse gate is at the reverse drive position;

a reverse gate mover including an electric motor that generates power to move the reverse gate between the reverse drive position and the forward drive position, and a transmission that defines a transmitting pathway connecting the electric motor and the reverse gate and transmits the power by the electric motor to the reverse gate; and an interrupter arranged to interrupt the transmitting pathway so that restraint of the reverse gate by the reverse gate mover is released by a joint that includes a stopper urged by a spring.

9. A jet propelled watercraft comprising:

a jet pump that jets water rearward from a jet port;

a reverse gate movable in an up/down direction between a reverse drive position at which an entirety of the jet port is covered by the reverse gate as seen in a rear view and a forward drive position at which the entirety of the jet port is open as seen in the rear view, the reverse gate being arranged to guide forward the water that has been guided to the jet port when the reverse gate is at the reverse drive position;

a reverse gate mover including an electric motor that generates power to move the reverse gate between the reverse drive position and the forward drive position, and a transmission that defines a transmitting pathway connecting the electric motor and the reverse gate and transmits the power by the electric motor to the reverse gate; and a withdrawal controller programmed to monitor for a malfunction in the reverse gate mover, the withdrawal controller further programmed to provide a withdrawal command to the electric motor when the reverse gate mover malfunctions to cause the reverse gate to move by a predetermined distance toward the forward drive position; wherein the withdrawal controller is programmed to monitor for the malfunction of the reverse gate mover based on detection values of a motor position detector and detection values of a reverse gate position detector.

10. The jet propelled watercraft according to claim 9, wherein the withdrawal controller is programmed to provide to the electric motor the withdrawal command to cause the reverse gate to move toward the forward drive position by the predetermined distance from the reverse drive position to the forward drive position.

11. The jet propelled watercraft according to claim 1, wherein the withdrawal controller is programmed to monitor for the malfunction of the reverse gate mover that causes the reverse gate to be in an up/down position other than an intended up/down position; and the intended up/down position is a position that the reverse gate should be in based on a command sent from the withdrawal controller to the reverse gate mover.

12. The jet propelled watercraft according to claim 1, wherein the withdrawal controller is programmed to monitor for the malfunction of the reverse gate mover based on whether or not the detection values from the motor position detector match motor position command values from the withdrawal controller.

13. The jet propelled watercraft according to claim 1, wherein the withdrawal controller is programmed to monitor for the malfunction of the reverse gate mover based on whether or not the detection values from the reverse gate position detector match reverse gate position command values from the withdrawal controller.

14. The jet propelled watercraft according to claim 1, wherein the withdrawal controller is programmed to monitor for the malfunction of the reverse gate mover based on whether or not the detection values of the motor position detector and the detection values of the reverse gate position detector satisfy a predetermined correlation.

15. The jet propelled watercraft according to claim 9, wherein the withdrawal controller is programmed to monitor for the malfunction of the reverse gate mover that cause the reverse gate to be in an up/down position other than an intended up/down position; and the intended up/down position is a position that the reverse gate should be in based on a command sent from the withdrawal controller to the reverse gate mover.

16. The jet propelled watercraft according to claim 9, wherein the withdrawal controller is programmed to monitor for the malfunction of the reverse gate mover based on whether or not the detection values from the motor position detector match motor position command values from the withdrawal controller.

17. The jet propelled watercraft according to claim 9, wherein the withdrawal controller is programmed to monitor for the malfunction of the reverse gate mover based on whether or not the detection values from the reverse gate position detector match reverse gate position command values from the withdrawal controller.

18. The jet propelled watercraft according to claim 9, wherein the withdrawal controller is programmed to monitor for the malfunction of the reverse gate mover based on whether or not the detection values of the motor position detector and the detection values of the reverse gate position detector satisfy a predetermined correlation.

* * * * *